US009328991B2

(12) United States Patent
Gale et al.

(10) Patent No.: US 9,328,991 B2
(45) Date of Patent: May 3, 2016

(54) FIREARM ACCESSORY ADAPTER AND RELATED METHODS OF USE

(71) Applicant: Chambermax L. L. C., Blaine, MN (US)

(72) Inventors: Brian D. Gale, Blaine, MN (US); David A. Sohm, Grantsburg, WI (US)

(73) Assignee: Chambermax L. L. C., Blaine, MN (US)

( * ) Notice: Subject to any disclaimer, the term of this patent is extended or adjusted under 35 U.S.C. 154(b) by 0 days.

(21) Appl. No.: 14/243,495

(22) Filed: Apr. 2, 2014

(65) Prior Publication Data

US 2014/0298703 A1 Oct. 9, 2014

Related U.S. Application Data

(60) Provisional application No. 61/808,051, filed on Apr. 3, 2013.

(51) Int. Cl.
*F41A 3/72* (2006.01)
*F41C 27/00* (2006.01)
*F41G 1/10* (2006.01)

(52) U.S. Cl.
CPC . *F41C 27/00* (2013.01); *F41A 3/72* (2013.01); *F41G 1/10* (2013.01); *Y10T 29/49826* (2015.01); *Y10T 29/49963* (2015.01)

(58) Field of Classification Search
CPC ..... F41A 3/72; F41A 19/34; F41A 19/35; F41A 19/37; F41A 19/38; F41A 19/40; F41C 27/00; F41G 1/10; Y10T 29/49963; Y10T 29/49826
USPC ..... 89/1.4, 1.42; 42/70, 71.02
See application file for complete search history.

(56) References Cited

U.S. PATENT DOCUMENTS

| | | | | |
|---|---|---|---|---|
| 6,493,978 | B1 * | 12/2002 | Perkins | F41A 17/02 42/70.08 |
| 8,191,301 | B2 * | 6/2012 | Hatfield | F41A 19/34 42/90 |
| 8,312,803 | B2 | 11/2012 | Oz | |
| 2004/0200109 | A1 * | 10/2004 | Vasquez | 42/1.01 |
| 2011/0154710 | A1 * | 6/2011 | Hatfield | F41A 19/34 42/90 |
| 2012/0198744 | A1 * | 8/2012 | Meller et al. | 42/90 |

FOREIGN PATENT DOCUMENTS

DE 609 368 * 2/1935

* cited by examiner

*Primary Examiner* — Stephen M Johnson
(74) *Attorney, Agent, or Firm* — Patterson Thuente Pedersen, P.A.

(57) ABSTRACT

A slide cover plate adapter and related methods of use for adding functionality to a semi-automatic handgun. The slide cover plate adapter replaces a factory slide cover plate located at a rear wall of a slide assembly in conventional semi-automatic handguns. The slide cover plate adapter includes a channel engagement portion and an accessory engagement portion that are spaced apart and coupled with a bridging member. The channel engagement portion operably couples to the slide assembly while the accessory engagement portion provides a convenient attachment point for any of a variety of handgun accessories.

13 Claims, 17 Drawing Sheets

Fig. 4
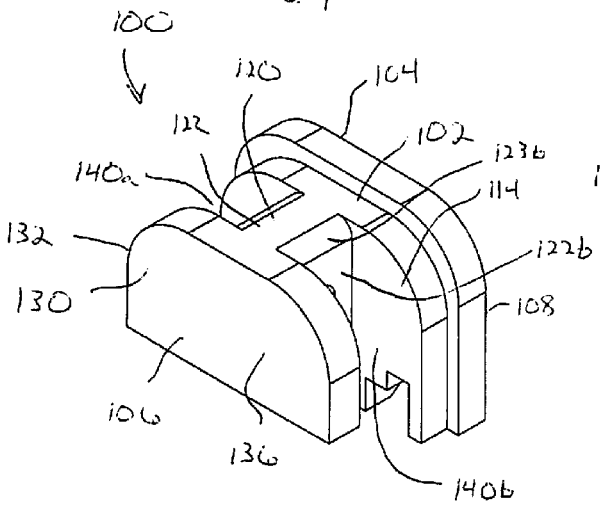
Fig. 5
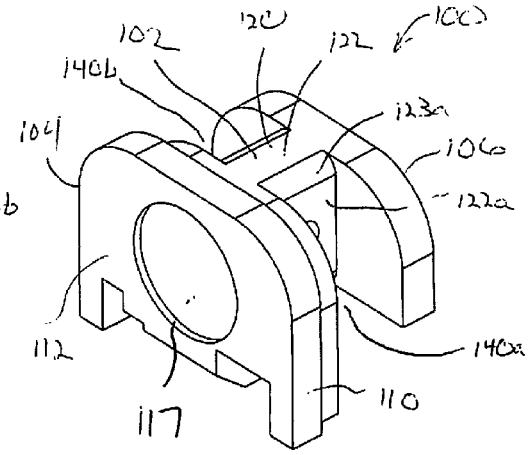
Fig. 6
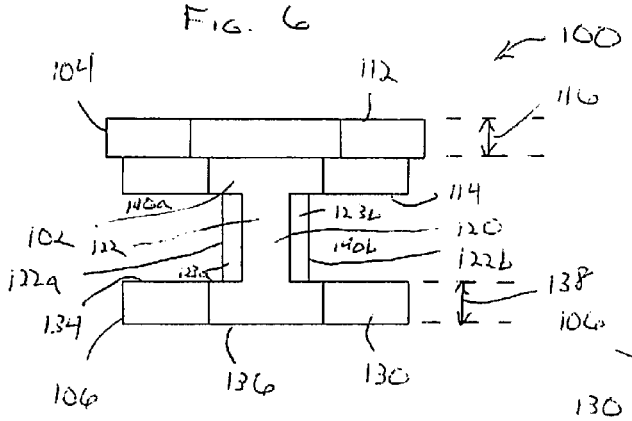
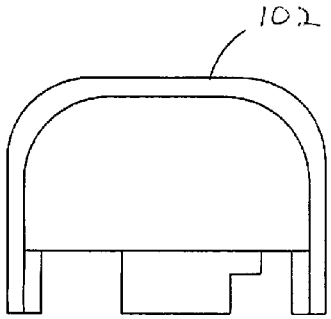
Fig. 7
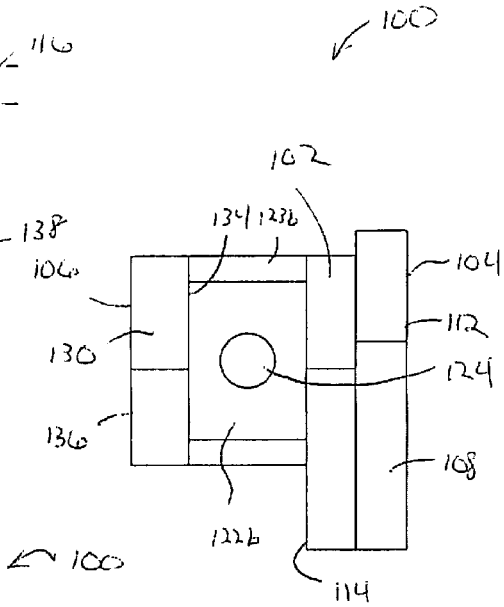
Fig. 8

FIG. 12
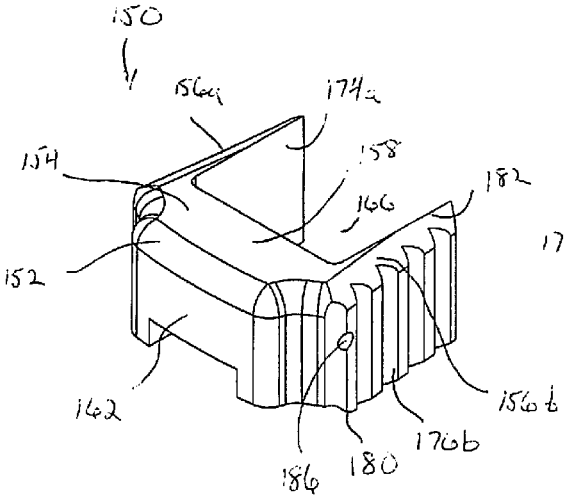
FIG. 13
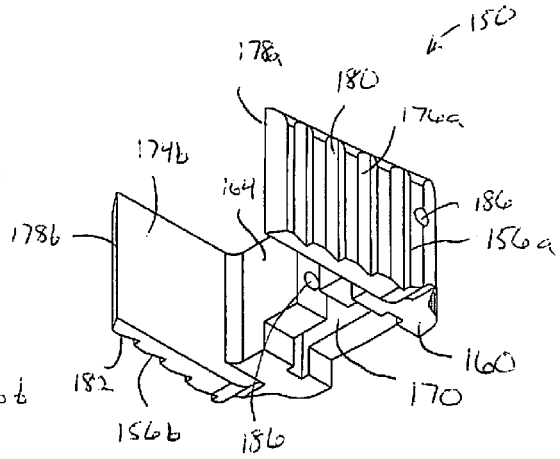
FIG. 14
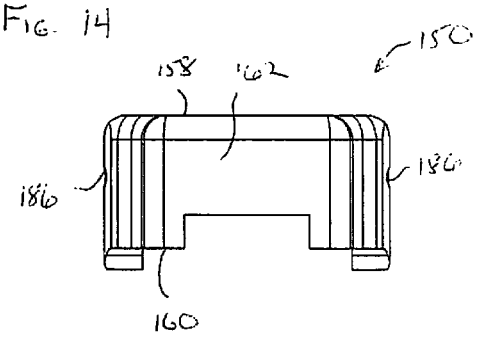
FIG. 15
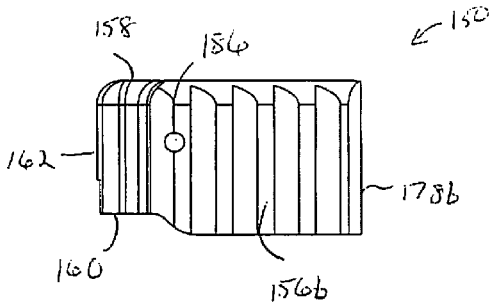
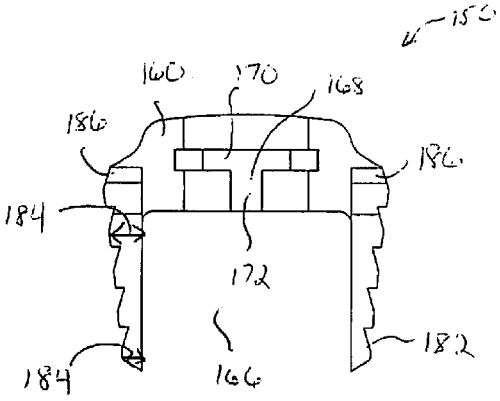
FIG. 16
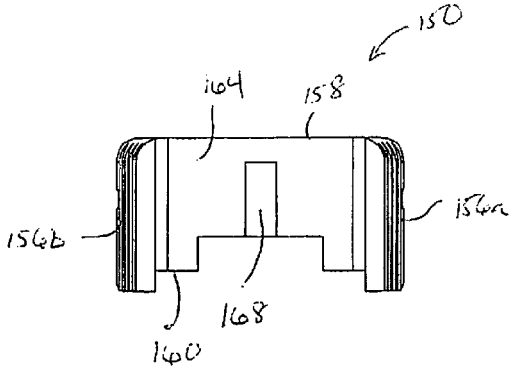
FIG. 17

Fig. 20
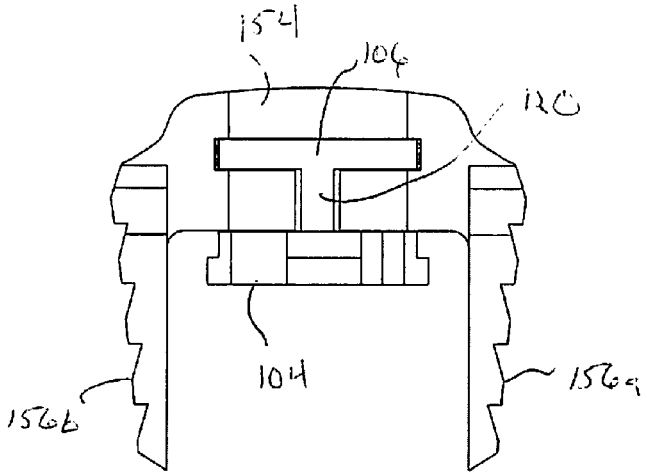
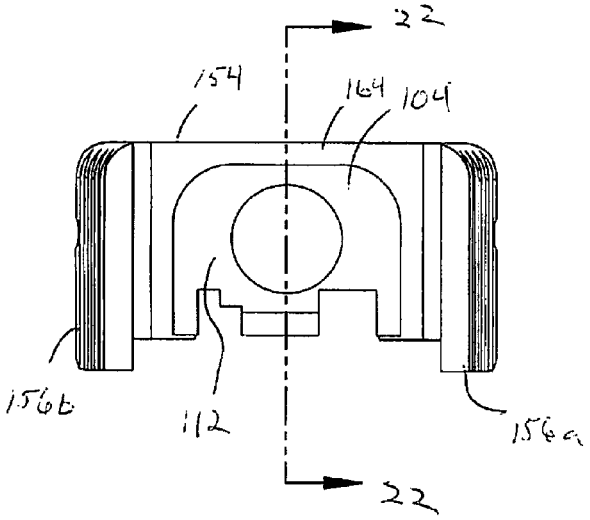
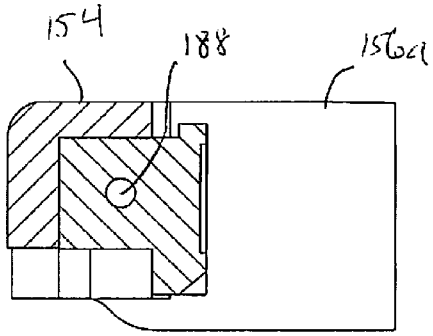
Fig. 22
Fig. 21

FIG. 25
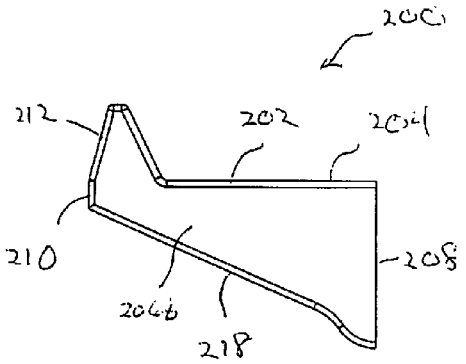
FIG. 29
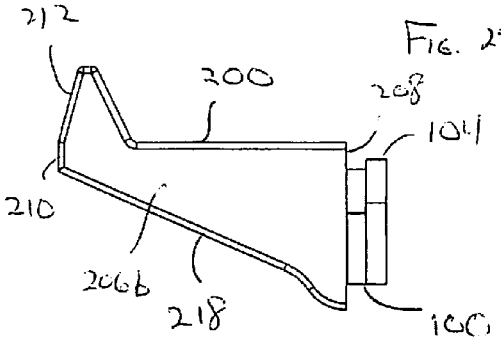
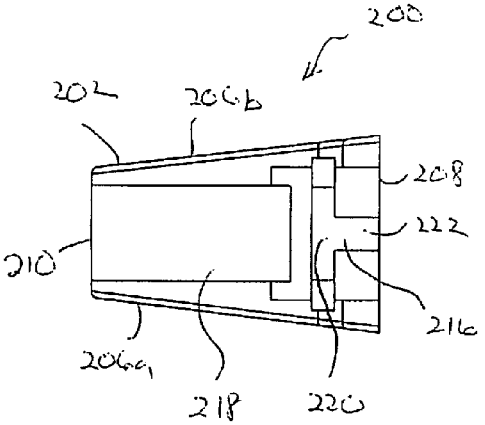
FIG. 26
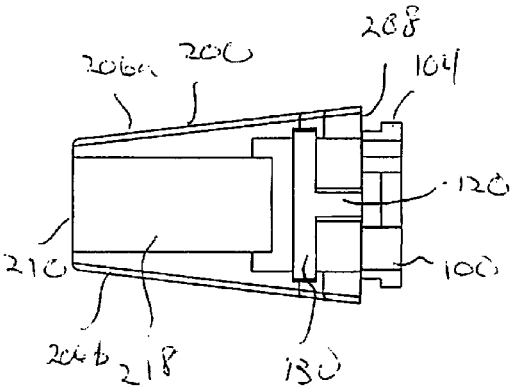
FIG. 30

FIREARM ACCESSORY ADAPTER AND RELATED METHODS OF USE

RELATED APPLICATION

The present application claims priority to U.S. Provisional Application No. 61/808,051, filed Apr. 3, 2013, and entitled "APPARATUS AND METHODS FOR HANDGUN SLIDE ASSEMBLY", which is hereby incorporated by reference in its entirety.

FIELD OF THE INVENTION

The present invention is related to a handgun adapter and related methods of using the adapter to increase durability, functionality and safety. More specifically, the present invention is directed to an adapter that is positioned into a rear portion of an upper receiver assembly of a semi-automatic handgun and that includes a protruding member which is engageable to a variety of accessories having a mating cavity configured for attachment to the protruding member.

BACKGROUND OF THE INVENTION

Modifying firearms to optimize performance or to simply improve aesthetics is a popular pastime of gun owners. For example, the use of Weaver and Picatinny rails on long guns and handguns provides the ability to add an almost unlimited number and type of accessories. For example, picatinny rails on long guns such as the AR-15 and other AR-style rifles allow for the addition of tactical accessories such as lasers, flashlights and strobe lights, optical accessories such as scopes, reflex sights, red-dot sights and night vision as well as other items such as, for example, slings, bipods and many other options. While similar rails can be positioned above and below a handgun barrel, the space on a handgun is substantially reduced as compared to long guns.

One accessory that has been found to be beneficial with semi-automatic handguns is assisting devices used in cycling the slide assembly. Conventional semi-automatic handguns made by manufacturers such as Glock®, Smith & Wesson®, Springfield Armory USA®, Taurus®, Sig Sauer®, Kimber® and the like generally make use of a slide assembly to load, cycle and fire individual rounds. When loading an initial round into a chamber, a user must generally pull or "slide" the slide assembly to a rearward position, whereby a topmost round is directed upward from a magazine and into the chamber. The force required to direct the slide assembly to the rearward position can be more than a user expects and in some cases, create difficulty for smaller or older individuals to operate. Manufacturers have addressed this by creating ribs, channels and/or similar features on the sides of the slide assembly to provide a gripping area by which the user can more easily retain and apply force to the slide assembly. However, these gripping areas are often times insufficient for certain users.

In order to accommodate certain users, a variety of add-on accessories have been developed to further assist in operation of the slide. For example, U.S. Pat. No. 8,191,301 to Hatfield and U.S. Pat. No. 8,312,803 to Oz teach devices to assist in operating the slide assembly. However, these devices suffer from durability and functionality issues such as, for example, rendering conventional holsters inoperative, creating safety risks by providing surfaces for hanging up on or otherwise catching on clothing or equipment and the potential for separation from the slide assembly in the event of the handgun being dropped or otherwise impacted. In addition, some of these devices are not easily repairable or removable in the field without rendering the handgun inoperable, which can lead to life-threatening situations in a combat or emergency situation.

As such, it would be advantageous to further improve upon existing handgun slides and accessories such that the disadvantages of the prior art are overcome. In addition, it would be advantageous to provide additional functionality to the conventional handgun by allowing for the secure attachment of accessories. Finally, it would be advantageous to increase an accessory capacity of the conventional handgun.

SUMMARY OF THE INVENTION

The present invention is directed to an accessory adapter for attachment to a handgun slide assembly. The accessory adapter can replace an existing factory slide cover plate located at a rear end of the slide assembly in conventional semi-automatic handguns. The adapter can comprise a body portion geometrically sized and shaped to be slidably engageable into a cover plate channel at the rear end of the slide assembly of a specified manufacturer's handgun. The adapter can have a pair of protruding flange features creating an H-shaped member coupling to the handgun slide assembly on one side, and engaging an accessory mating cavity on the other side. The protruding flanges can be mated to a center bridging section, thereby creating the H-shape and are generally parallel to the geometrically shaped adapter portion of the slide. The H-shape can define a protruding member having cavity spaces that are adapted for receipt of a mating cavity in an accessory device.

In one aspect of the present invention, an accessory can be attached to a handgun by utilizing a mating cavity on the accessory to attach to a protruding member on an accessory adapter that is engaged to a rear portion of a slide assembly. The accessory can be coupled to an attachment portion of the accessory adapter by sliding the mating cavity of the accessory over the protruding member of the adapter. Secure engagement of the protruding member and the mating cavity can be accomplished through the use of friction or interference fits for accessory retention, a retention pin, securing screw, snap feature, embedded magnets, or a combination thereof.

In another aspect, the present invention can be directed to a method for adding functionality to a semi-automatic handgun. The method can comprise replacing a stock or factory slide cover plate with a slide cover plate adapter having a coupling mechanism. The method can further comprise attaching an accessory device to the coupling mechanism such that the accessory device is secured to the handgun. The method can further comprise removing the accessory device from attachment to the slide cover plate adapter followed by attachment of a second accessory device to the same slide cover plate adapter.

In another aspect of the present invention, a two-piece accessory system can be used to add additional functionality to a semi-automatic handgun. For example, a two-piece accessory can comprise an accessory adapter and a gripping accessory. Generally, the accessory adapter can assume the form of a slide cover plate adapter and can replace an existing, factory or stock slide cover plate of the "stock" handgun slide assembly such that the accessory adapter is functionally integral to the handgun slide assembly. With the accessory adapter becoming a functional part of the handgun slide assembly, the gripping accessory can be coupled to the accessory adapter, thereby providing additional gripping functionality to the handgun without concern that the gripping accessory can become dislodged or without requiring permanent modification or gunsmithing of the handgun.

In another aspect of the present invention, a gripping accessory for charging a semi-automatic handgun is disclosed. The gripping accessory can comprise a two-piece accessory, which when attached to a handgun slide assembly essentially becomes a part of the handgun slide assembly so as to remove risks associated with the accessory being removed or made loose by dropping or otherwise impacting the handgun. The two-piece accessory can comprise a slide cover plate adapter and a gripping device. In one representative embodiment, the two-piece accessory of the present invention uses differing materials for the slide cover plate adapter and the gripping accessory. Using differing materials provides a distinct advantage as application appropriate materials can be selected for the slide cover plate adapter and the gripping accessory to optimize characteristics such as weight, balance, texture/feel, and durability; materials can be mixed and matched for best performance, such as, for example, softer durometer plastics and coinjected molding approaches. In the event that the operator does not like the characteristics of a gripping geometry or material utilized in the gripping accessory, the user can swap the gripping accessory for a more preferred version utilizing a different geometry or material without changing the slide cover plate adapter. In addition, if the gripping accessory is made from a polymeric material such as, for example, a desired plastic and the gripping accessory breaks or fails due to the firearm being dropped or impacted, this breakage does not impede the basic functionality of the firearm. The slide cover plate adapter is generally made from polymer, composite or metals such as, steel or aluminum, and can comprise the same materials utilized for the factory or stock cover plates. The construction of the slide cover plate adapter allows for it to be a highly survivable part.

In another representative embodiment, a two-piece accessory of the present invention allows for operation of the handgun with a gripping accessory removed from the attachment to a slide cover plate adapter. If a situation arose in which the gripping accessory breaks, becomes excessively dirty or otherwise makes operation of a handgun slide assembly difficult, a semi-automatic handgun will still function safely and effectively without the gripping accessory installed. In addition, should the need ever arise in either a combat or emergency situation, the gripping accessory can be quickly removed from the slide cover plate adapter while retaining full functionality and safety of the handgun. This can be highly desirable for military and law enforcement or situations where high reliability is needed in the firearm.

In another representative embodiment, a two-piece handgun accessory of the present invention overcomes the significant safety risks of current slide accessories associated with holsters or clothing by incorporating a lower profile wedge geometry into a gripping accessory that couples to a slide cover plate adapter such that the gripping accessory does not protrude excessively off the side of the pistol, if at all. The lower profile wedge geometry of the gripping accessory can have an increased gripping surface by using or incorporating various textures, ribs or otherwise altered materials. The lower profile wedge geometry of the gripping accessory can be holster compliant so as to not "print" clothing, i.e., it does not protrude from the side of the pistol or holster in such a way as to lift clothing, or otherwise reveal the presence of a concealed pistol. This can be highly beneficial in situations where it is not desired for a user to advertise the presence of a handgun such as, for example, in undercover or plain clothes law enforcement situations, in security and personal protection details or by concealed carry permit holders.

In another representative embodiment, a two-piece accessory of the present invention offers a manufacturing advantage as the slide cover plate adapter can be designed and manufactured to operate and replace manufacturer or model specific slide cover plate designs, while utilizing a common gripping accessory and attachment mechanism across multiple handgun manufacturers and models.

In another representative embodiment, a two-piece accessory including a slide cover plate adapter and an accessory device is quickly and easily removable from the handgun slide assembly for field stripping and cleaning.

In another representative embodiment, a two-piece accessory provides a greater platform of operational safety for any shooter by securely coupling a gripping accessory having a positive hand and finger location wedge geometry to a slide cover plate adapter for loading, unloading, reloading, and remediating a handgun jam with the pistol. The gripping accessory further provides a directed and specific location of weapons operation that keeps the hand, fingers, and associated parts away from moving parts of the handgun slide assembly In another representative embodiment, a two-piece accessory provides a slide cover plate adapter upon which an accessory device can be securely coupled. For example, the slide cover plate adapter can allow for the attachment of accessory devices including a holster retention snap or article, a piece of cord, an extended sight radius piece or similar accessories can be operably attached to the slide end cap geometry. For competitive shooters or handgun hunters, the slide cover plate adapter can serve as a mounting platform for an extended sight radius or longer sight platform. An extended sight radius accessory can couple to the slide cover plate adapter, which serves to increase the sight radius of the handgun by extending a rear sight position in a rearward direction and further away from a front sight of the handgun. By maximizing a distance between front and rear sights, the available sight radius is increased, which can increase handgun accuracy.

In another representative embodiment, a two-piece accessory provides customization for critical operations such as, for example, those performed by law enforcement, military, security, protective detail, or plain clothes undercover operator. With the two piece accessory design, a slide cover plate adapter can be securely incorporated into a cover channel on a slide body while an accessory device having application specific colors and textures can be replaceably attached to the slide cover plate adapter based upon the specific needs and desires of the user.

In another representative embodiment, a two-piece accessory including a slide cover plate adapter and an accessory device can be constructed from the same or similar materials utilized by handgun manufacturers so as to be aesthetically pleasing and give the impression of being an integral part of the firearm. In addition, an accessory device configured as a gripping accessory can have a lower profile wedge geometry so as to have less visual impact to overall aesthetics and to appear as if a stock or factory component integral to a handgun.

In another representative embodiment, a two-piece handgun accessory provides for tactical operational advantages that enhance the use, operations, and remediation of the handgun using tactical gloves, in cold or wet weather, and in maritime or waterborne operations by improving grip on the handgun. In addition, a variety of shapes, additions, or configurations to the weapons system which can be custom designed and fitted to the handgun desired by the user and based upon necessity or tactical operations performed by the user.

In another representative embodiment, an improved slide cover plate adapter can be incorporated into a handgun slide assembly to replace a stock slide cover plate. The improved slide cover plate adapter can incorporate a coupling mechanism, such as, for example, a projecting member, a dovetail or threaded hole for attaching to a gripping accessory. Based on the needs and wants of the user, an accessory device having a mounting member such as, for example, a mounting cavity, can be fabricated from any of a variety of suitable materials and configurations that are replaceable and interchangeable with the improved slide cover plate adapter without necessitating removal or replacement of the improved slide cover plate adapter from the handgun slide assembly. In addition, the coupling mechanism can provide a platform for attaching a variety of alternative accessory devices such as, for example, a holster retention snap or article, a piece of cord, an extended sight radius piece or similar accessories with the benefit of the improved slide cover plate adapter being functionally integral to the handgun slide assembly. In this way, the improved slide cover plate adapter can be utilized to incorporate additional functionality into the handgun that may not have been possible based on the design and geometry of a handgun chassis or the handgun slide assembly in its original, stock configuration.

The above summary of the various representative embodiments of the invention is not intended to describe each illustrated embodiment or every implementation of the invention. Rather, the embodiments are chosen and described so that others skilled in the art can appreciate and understand the principles and practices of the invention.

BRIEF DESCRIPTION OF THE FIGURES

Various embodiments of the invention are now described by way of example to further the understanding of the present disclosure, with reference to the accompanying drawings in which:

FIG. 4 is a perspective view of a slide cover plate adapter according to an embodiment of the present invention.

FIG. 5 is a perspective view of the slide cover plate adapter of FIG. 4.

FIG. 6 is a top view of the slide cover plate adapter of FIG. 4.

FIG. 7 is an end view of the slide cover plate adapter of FIG. 4.

FIG. 8 is a side view of the slide cover plate adapter of FIG. 4.

FIG. 12 is a perspective view of a gripping accessory according to an embodiment of the present invention.

FIG. 13 is a perspective view of the gripping accessory of FIG. 12.

FIG. 14 is an end view of the gripping accessory of FIG. 12.

FIG. 15 is a side view of the gripping accessory of FIG. 12.

FIG. 16 is a bottom view of the gripping accessory of FIG. 12.

FIG. 17 is an end view of the gripping accessory of FIG. 12.

FIG. 20 is a bottom view illustrating coupling of the slide cover plate adapter of FIG. 4 with the gripping accessory of FIG. 12.

FIG. 21 is an end view illustrating coupling of the slide cover plate adapter of FIG. 4 with the gripping accessory of FIG. 12.

FIG. 22 is a section view illustrating coupling of the slide cover plate adapter of FIG. 4 with the gripping accessory of FIG. 12 taken at line 22-22 of FIG. 21.

FIG. 25 is a side view of the rear sight accessory of FIG. 24.

FIG. 26 is a bottom view of the rear sight accessory of FIG. 24.

FIG. 29 is a side view illustrating coupling of the slide cover plate adapter of FIG. 4 with the rear sight accessory of FIG. 24.

FIG. 30 is a bottom view illustrating coupling of the slide cover plate adapter of FIG. 4 with the rear sight accessory of FIG. 24.

Figure 1:
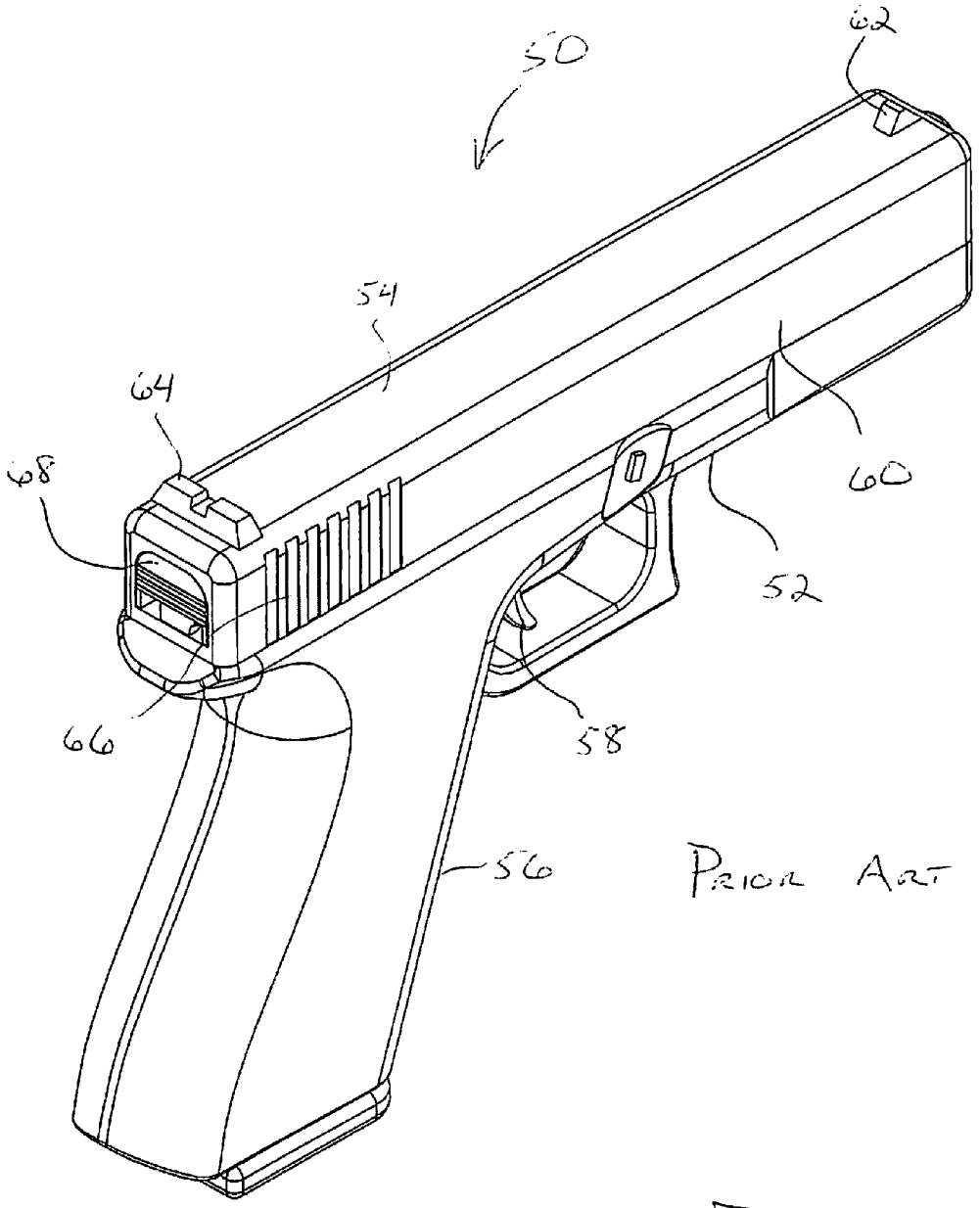
PRIOR ART FIG. 1
FIG. 1 is a perspective view of a semi-automatic handgun of the prior art.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE FIGURES

Figure 2:
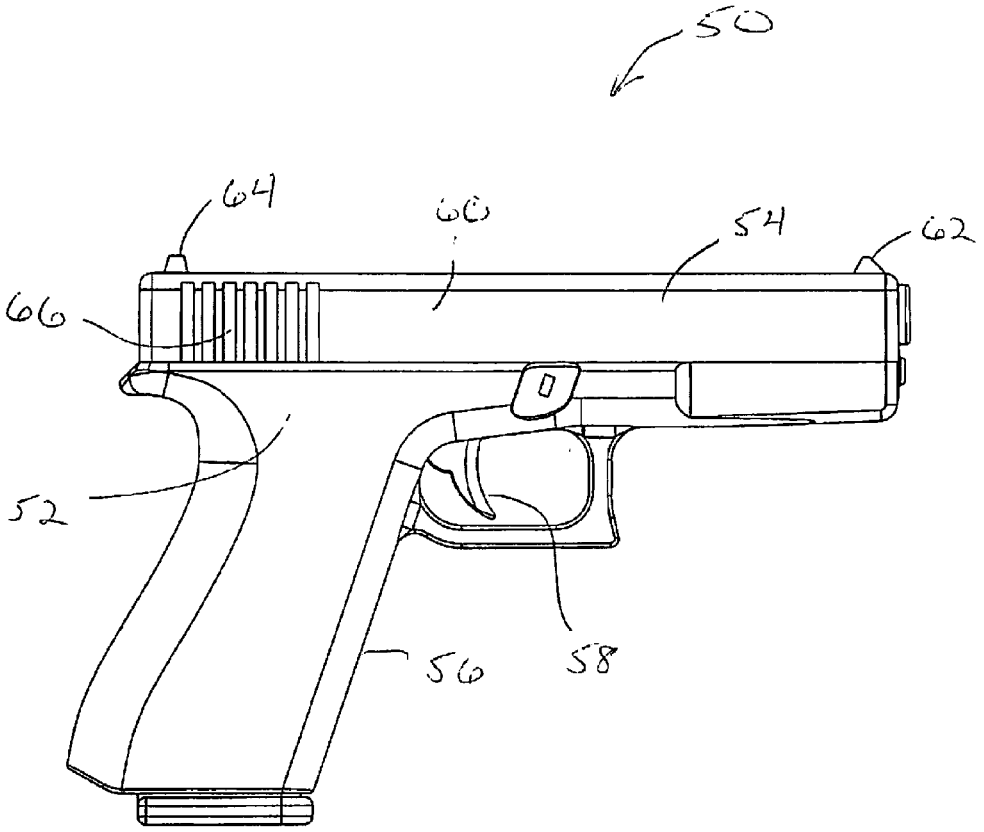
PRIOR ART FIG. 2
FIG. 2 is a side view of the semi-automatic handgun of FIG. 1.
Figure 3:
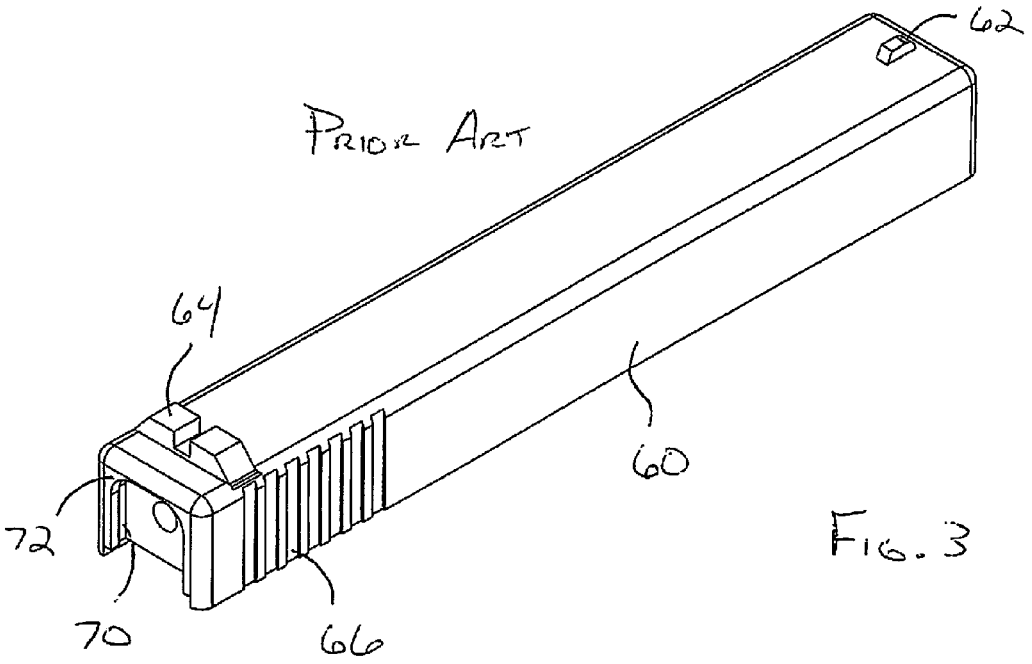
FIG. 3 is a perspective view of a slide body used in the semi-automatic handgun of FIG. 1.

As illustrated in FIGS. 1 and 2, a conventional semi-automatic handgun 50 of the prior art generally comprises a frame 52 and a slide assembly 54. Frame 52 can comprise a grip 56 and a trigger 58. Slide assembly 54 generally comprises a slide body 60, a front sight 62, a rear sight 64, a plurality of gripping ribs 66 and a slide cover plate 68. Generally, the slide body 60 mounts in a rail portion (not shown) of the frame 52 such that the slide assembly 54 can slide back and forth relative to the frame 52 for loading shells from a magazine within the grip 56. Slide assembly 54 can be manually directed in a rear direction using the gripping ribs 66 or the slide assembly 54 can be driven rearward in response to forces experienced when a shell is fired from handgun 50. As seen in FIG. 3, slide cover plate 68 is dimensioned and fabricated to slide into and fit within a cover channel 70 defined at a rear wall 72 of the slide body 60. Slide cover plate 68 retains and provides an operational surface for the firing pin and extractor plunger assembly (not illustrated) during operation of the semi-automatic handgun 50.

Referring now to FIGS. 4-8, an embodiment of a slide cover plate adapter 100 of the present invention can comprise an adapter body 102 having a channel engagement portion 104 and an accessory engagement portion 106. Generally, end cap engagement portion 104 is defined by an engagement wall 108 having an engagement profile 110, a slide cover operational surface 112, an exterior facing surface 114 an a wall thickness 116. Slide cover operational surface 112 includes a recessed portion 117 for receiving and engaging the firing pin assembly (not illustrated). Generally, the engagement wall 108 including the engagement profile 110 and wall thickness 116 are selected to be substantially identical in shape and dimensions (length, width, thickness) to that of slide cover plate 68 such that the engagement wall 108 can be slidably advanced into the slide channel 70 with the same fit and finish as slide cover plate 68. It will be understood that end cap engagement portion 104 will have differing engagement wall profiles and wall thicknesses for differing manufacturers and models and that the present invention is not limited to specific manufacturers or models but that similar principles extend across a range of handgun manufacturers and models.

Extending from the exterior facing surface 114 is a bridging member 120. Bridging member 120 interconnects the end cap engagement portion 104 and accessory engagement portion 106. Generally bridging member 120 includes a bridging wall 122 having a pair of opposed bridging surfaces 122*a*, 122*b*. In some embodiments, the opposed bridging surfaces 122*a*, 122*b* can reside in substantially parallel planes to one another, while in other alternative embodiments, the opposed bridging surfaces 122*a*, 122*b* can be arranged so as to not reside in parallel planes. In addition, bridging surfaces 122*a*, 112*b* can each include an angled or tapered surface 123*a*, 123*b*. In some embodiments as shown in FIG. 8, bridging member 120 can comprise a bridging aperture 124 that extends continuously between the opposed bridging surfaces 122*a*, 122*b* and through the bridging wall 122.

Attached to the bridging member 120 is the accessory engagement portion 106. Generally, accessory engagement portion 106 comprises a flange wall 130 having a flange profile 132, a flange interior surface 134, a flange exterior surface 136 and a flange wall thickness 138. Cooperatively, the flange interior surface 134, the bridging wall 122 and the exterior facing surface 114 define a pair of receiving areas 140*a*, 140*b* between the channel engagement portion 104 and the accessory engagement portion 106.

Slide cover plate adapter 100 is a unitary undivided single piece body formed with materials appropriate for successful firearm operation. Generally, slide cover plate adapter 100 can comprise materials such as, for example, polymeric and composite material as well as metals such as aluminum, stainless steel, titanium and the like that are durable. Slide cover plate adapter 100 can have material finishes such as, for example, being anodized, nickel-plated or brushed so as to match the finish of semi-automatic handgun 50 and so as to have the fit and finish of an original manufacturer's part. In some embodiments, the surface of slide cover plate adapter 100 can be applied special finishes such as, for example, high visibility finishes, camouflage finishes or similar finishes based on the desires of a user.

Figure 9:
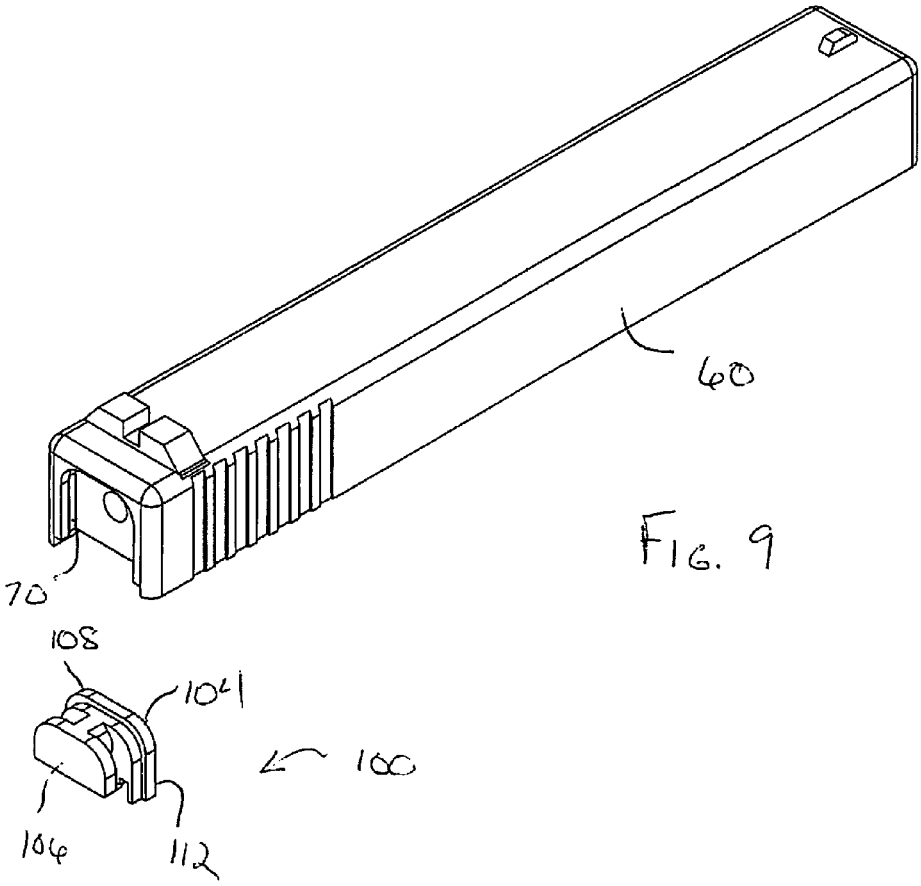
FIG. 9 is an exploded, perspective view of the slide cover plate adapter of FIG. 4 being positioned for attachment to the slide body of FIG. 3.
Figure 11:
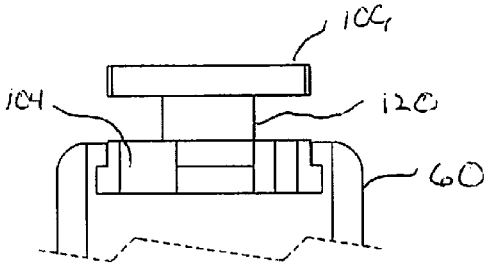
FIG. 11 is a bottom view of a portion of the adapted semi-automatic handgun of FIG. 10.
Figure 10:
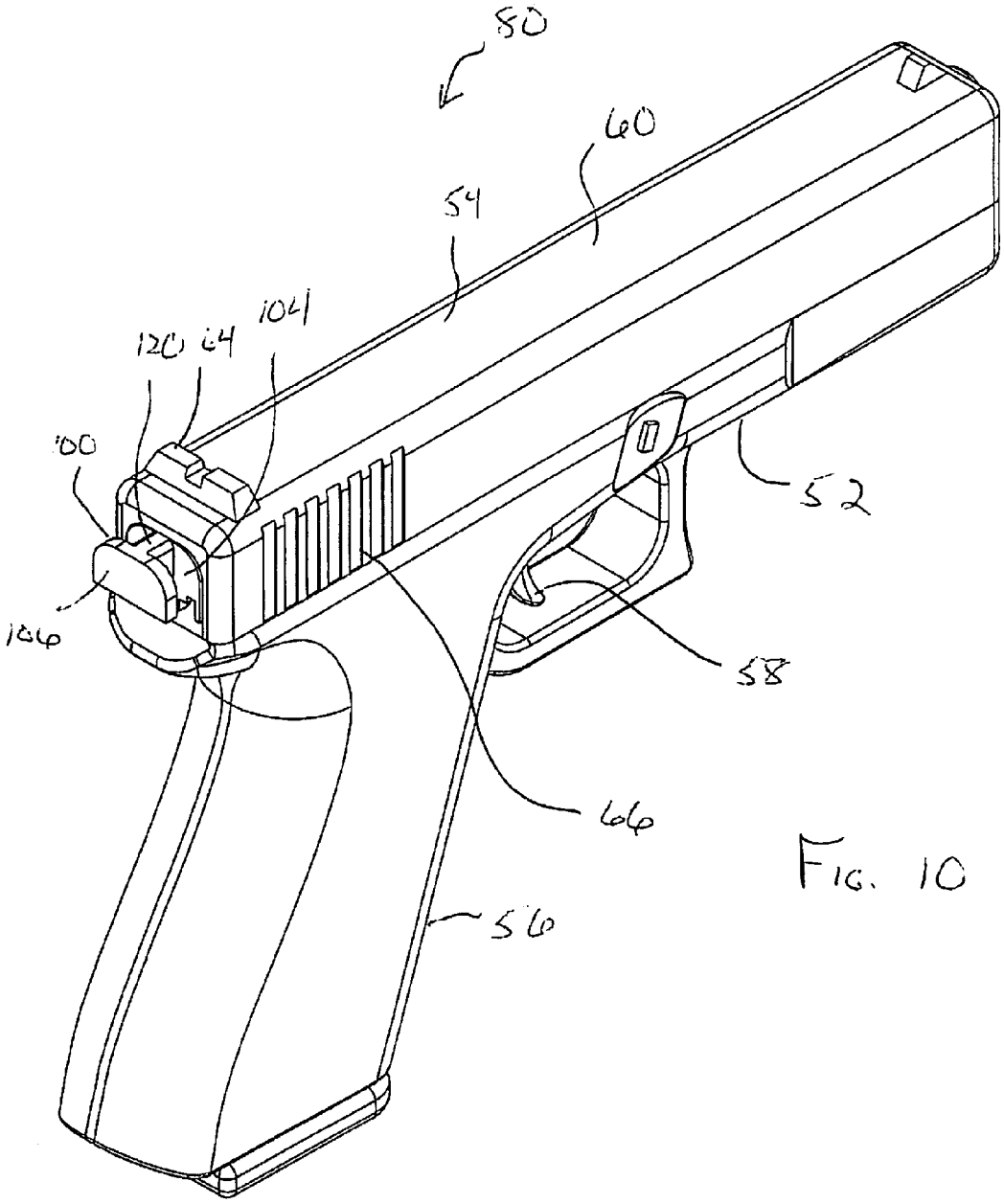
FIG. 10 is a perspective view of an adapted semi-automatic handgun according to an embodiment of the present invention.

To install the slide cover plate adapter 100, the user simply removes the slide cover plate 68 from the cover channel 70 by sliding the slide cover plate 68 in a downward direction relative to the slide body 60. Next, the user orients the slide cover plate adapter 100 as shown in FIG. 9 such that it is positioned below the slide body 60 with the end cap engagement portion 104, and more specifically, the slide cover operational surface 112 directed to be proximate the rear wall 72. The user then directs the engagement wall 108 upwards and into the cover channel 70 as shown in FIGS. 10 and 11. Due to the engagement wall 108 being fabricated to have the same profile and dimensions as the slide cover plate 68, the end cap engagement portion 104 attaches to and is retained within the cover channel 70 with the same fit and finish as the slide cover plate 68 so as to define an adapted semi-automatic handgun 80.

With the slide cover plate adapter 100 operably coupled to the slide body 60, a mounting platform for quickly and securely mounting various accessories to provide additional functionality and features to semi-automatic handgun 50 is provided. As will be described below, the accessories can comprise a variety of alternatively such as, for example, gripping accessories and sight accessories. In addition, slide cover plate adapter 100 can be utilized to provide an additional mounting platform on semi-automatic handgun 50 that allows for accessories designed to operate with conventional rail systems such as, for example, Picatinny and Weaver rail mount systems.

A representative embodiment of a gripping accessory 150 designed for use with slide cover plate adapter 100 is illustrated within FIGS. 12-17. Generally, gripping accessory 150 comprises a grip body 152 having a backspan 154 and a pair of grip sides 156*a*, 156*b*. Backspan 154 generally defines an upper grip surface 158, a lower grip surface 160, a rear grip wall 162 and an interior grip wall 164. The interior grip wall 164 and grip sides 156*a*, 156*b* cooperatively define a grip cavity 166. Grip cavity 166 is defined so as to essentially match a profile of the slide body 60. An accessory cavity 168 is defined within the lower grip surface 160 and generally includes a flange cavity 170 and a bridge cavity 172. Accessory cavity 168 is dimensioned and formed such that flange cavity 170 accommodates insertion of the flange wall 130 and bridge cavity 172 accommodates insertion of the bridging member 120. Grip sides 156*a*, 156*b* can have interior grip surfaces 174*a*, 174*b* and exterior grip surfaces 176*a*, 176*b* and define a pair of forward grip surfaces 178*a*, 178*b*. The exterior grip surfaces 176*a*, 176*b* can include alternating gripping ribs 180. In some embodiments, the gripping ribs 180 can be formed to provide a wedge profile 182 to the grip body 152, wherein a width dimension 184 of each successive gripping rib 180 increases from the forward grip surfaces 178*a*, 178*b* to the backspan 154. An accessory aperture 186 can extend between the exterior grip surfaces 176*a*, 176*b* so as to intersect the bridge cavity 172.

Figure 18:
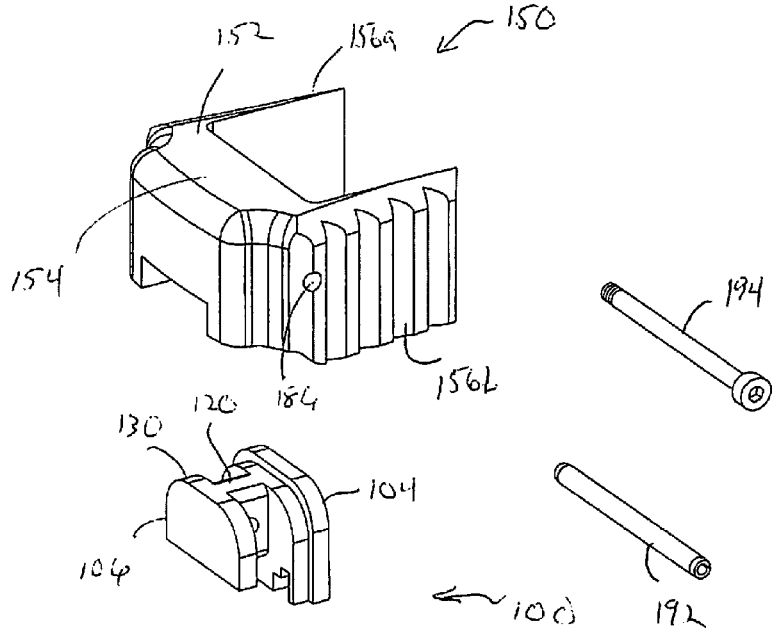
FIG. 18 is an exploded, perspective view illustrating coupling of the slide cover plate adapter of FIG. 4 with the gripping accessory of FIG. 12.
Figure 19:
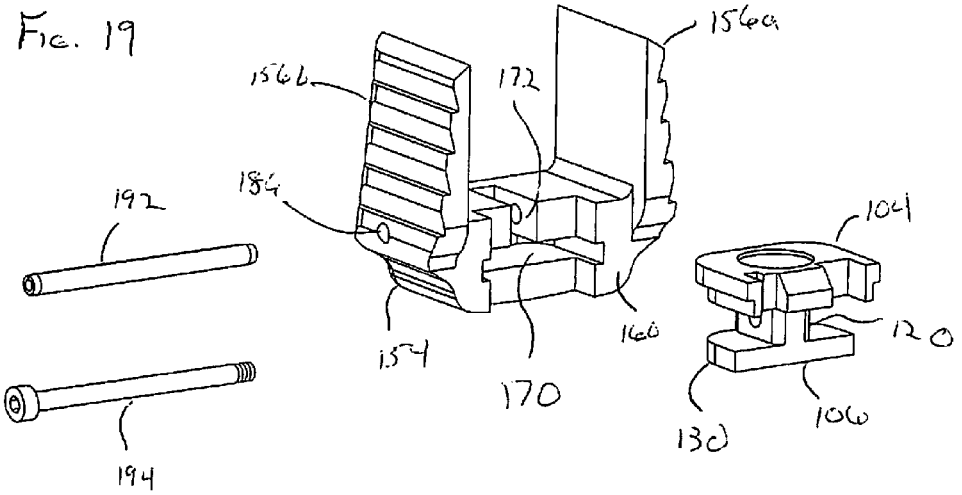
FIG. 19 is an exploded, perspective view illustrating coupling of the slide cover plate adapter of FIG. 4 with the gripping accessory of FIG. 12.
Figure 23:
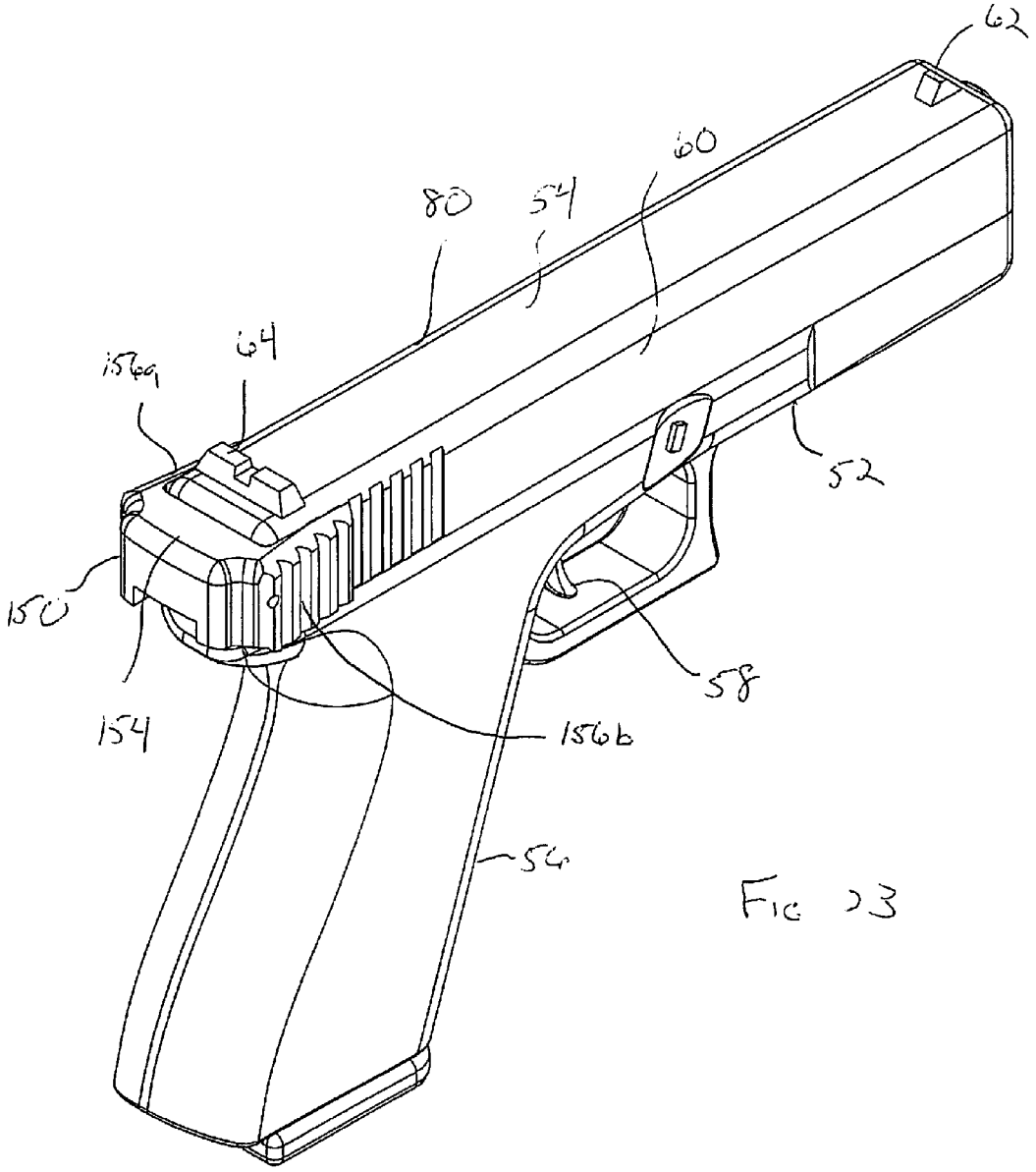
FIG. 23 is a perspective view of the adapted semi-automatic handgun of FIG. 10 including the gripping accessory of FIG. 12.

Gripping accessory 150 is operably coupled to adapted semi-automatic handgun 80, and more specifically, to slide cover plate adapter 100, by positioning the gripping accessory 150 above or to the side of accessory engagement portion 106 as illustrated in FIGS. 18 and 19. Generally, the grip body 152 is advanced such that the flange cavity 170 slides over the flange wall 130 and the bridge cavity 172 slides over the bridging member 120. When the flange wall 130 and bridging member 120 are fully seated within the accessory cavity 168, the accessory aperture 186 is aligned with the bridging aperture 124 to define a continuous locking aperture 188 extending between the exterior grip surfaces 176*a*, 176*b* and being defined within the grip body 152 and the adapter body 102. An insertion member can be inserted through the continuous locking aperture 188 to positively lock the gripping accessory to the slide cover plate adapter 100. In some embodiments, the insertion member can simply be a pin 192 that is held in place with a friction fit or alternatively, either of the grip sides 156*a*, 156*b* can have an internal thread within their portion of the accessory aperture 186 such that a threaded fastener 194 can inserted and rotatably locked within the continuous locking aperture 188. With the gripping accessory 150 coupled to the slide cover plate adapter 100 as described, slide body 60 fits snugly within the grip cavity 166 as shown in FIG. 23. The wedge profile 182 can simplify racking of the slide assembly 54 relative to the frame 52 by providing an enhanced gripping area for holding and racking the slide assembly 54.

Figure 24:
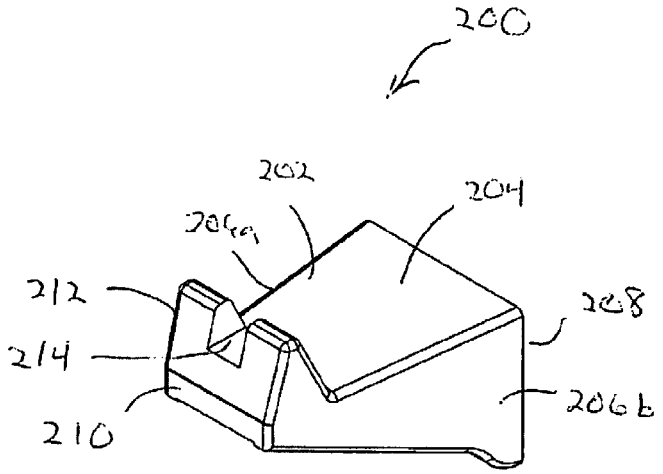
FIG. 24 is a perspective view of a rear sight accessory according to an embodiment of the present invention.
Figure 27:
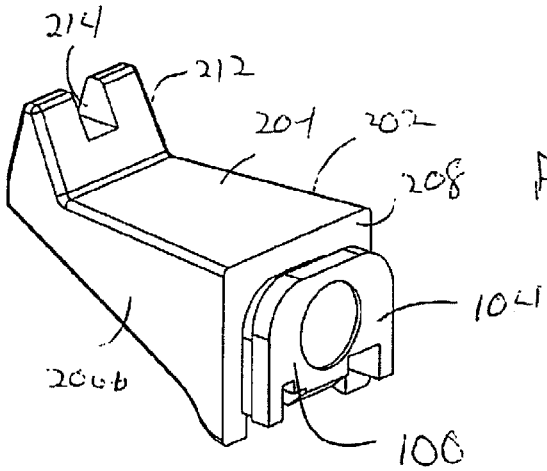
FIG. 27 is a perspective view illustrating coupling of the slide cover plate adapter of FIG. 4 with the rear sight accessory of FIG. 24.
Figure 28:
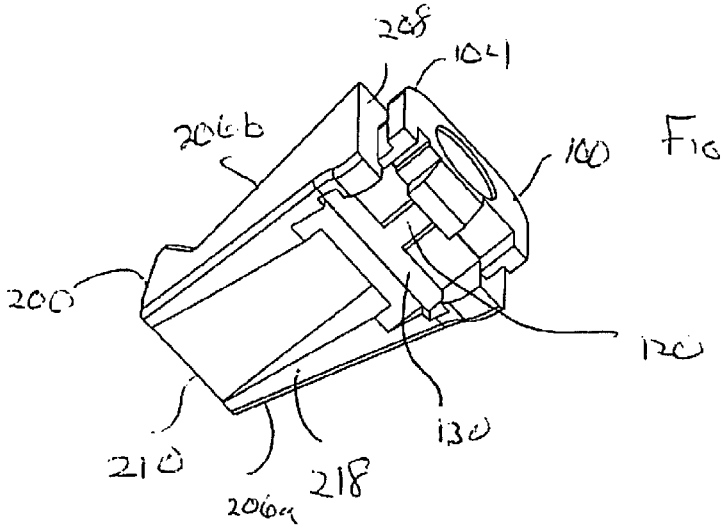
FIG. 28 is a perspective view illustrating coupling of the slide cover plate adapter of FIG. 4 with the rear sight accessory of FIG. 24.

A representative embodiment of a rear sight accessory 200 design for use with slide cover plate adapter 100 is illustrated within FIGS. 24-26. Generally, rear sight accessory 200 can comprise a sight body 202 having an upper surface 204, a pair of side surfaces 206*a*, 206*b*, a front sight surface 208 and a rear sight surface 210. Projecting upward from the upper surface 204 proximate the rear sight surface 210 is a rear sight 212 including an alignment cavity or aperture 214. An accessory cavity 216 can be defined on a bottom side 218 of the sight body 202, proximate the front sight surface 208. Accessory cavity 216 is essentially identical to accessory cavity 168 and includes a flange cavity 220 and a bridge cavity 222. Though not illustrated on sight body 202, it will be understood that side surfaces 206*a*, 206*b* could include accessory apertures similar to accessory aperture 186 and that could function to positively lock the rear sight accessory 200 to the slide cover plate adapter 100 with pin 192 or threaded fastener 194 as previously described with respect to the gripping accessory 150.

Figure 31:
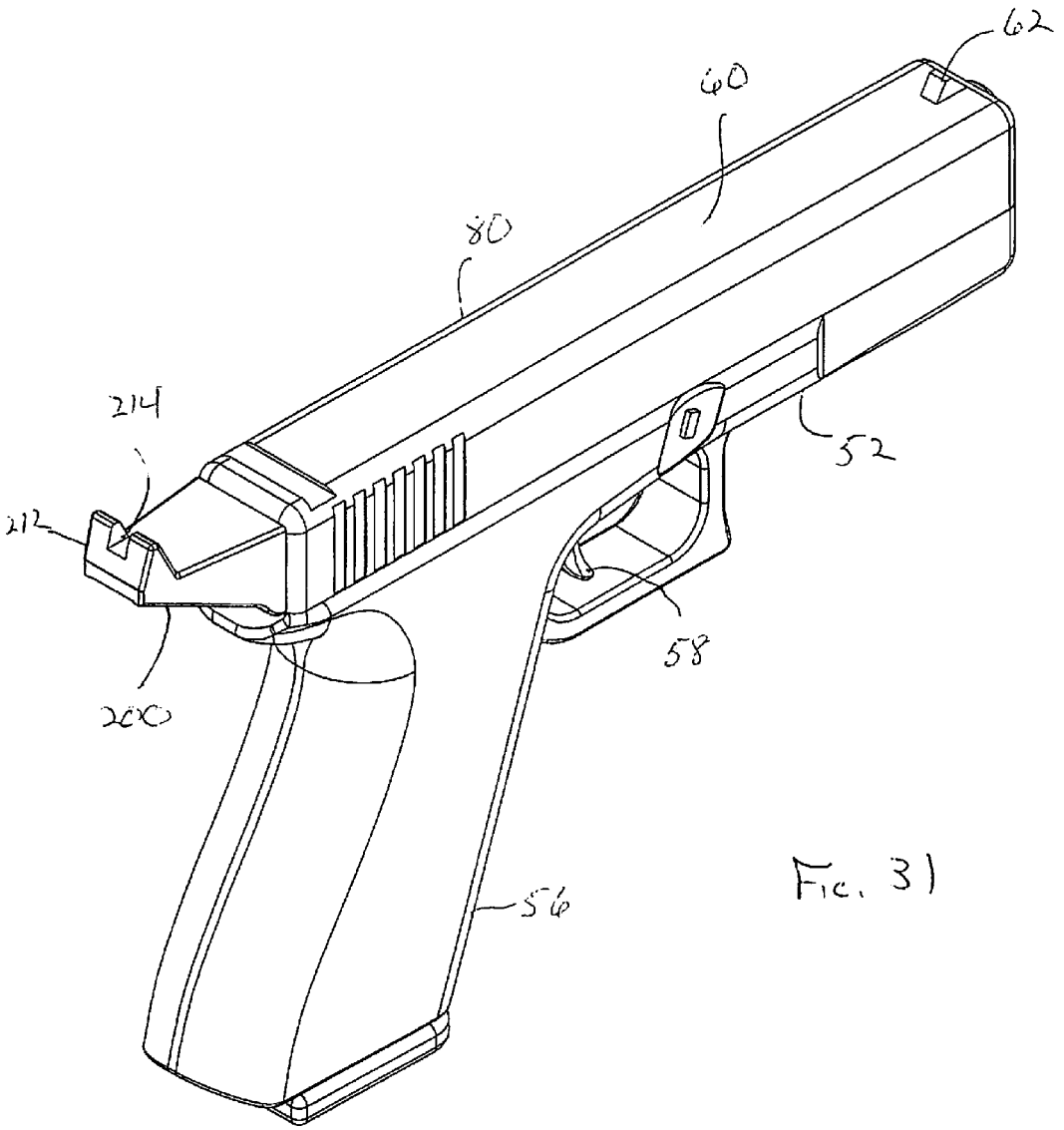
FIG. 31 is a perspective view of the adapted semi-automatic handgun of FIG. 10 including the rear sight accessory of FIG. 24.
Figure 32:
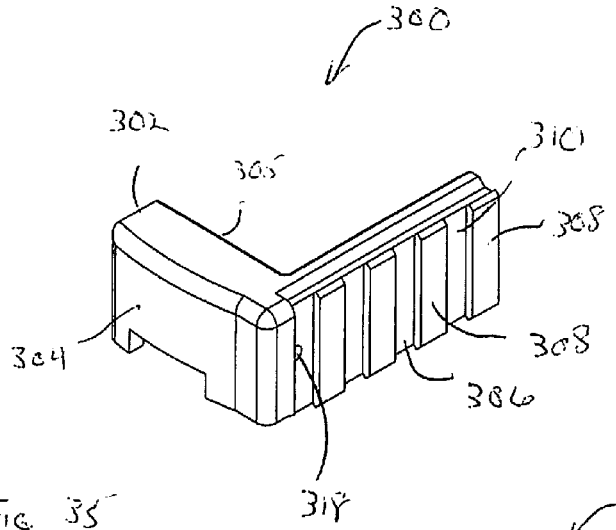
FIG. 32 is a perspective view of a mounting rail accessory according to an embodiment of the present invention.
Figure 35:
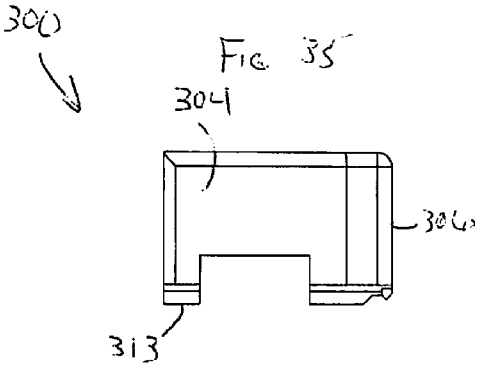
FIG. 35 is an end view of the mounting rail accessory of FIG. 32.
Figure 33:
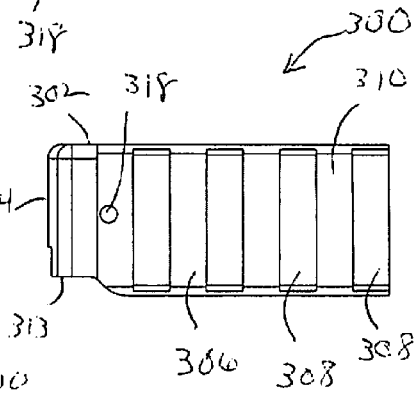
FIG. 33 is a side view of the mounting rail accessory of FIG. 32.
Figure 36:
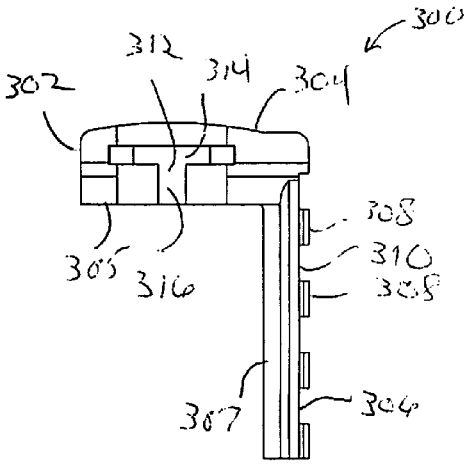
FIG. 36 is a bottom view of the mounting rail accessory of FIG. 32.
Figure 34:
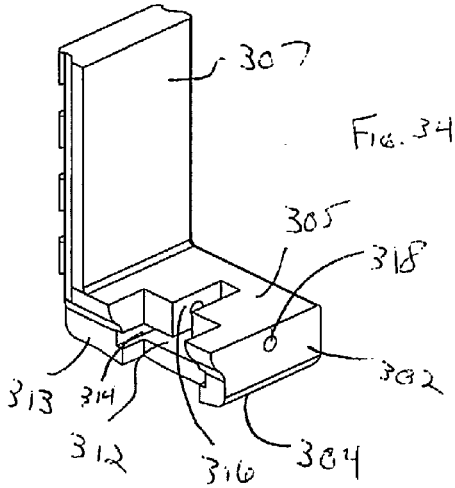
FIG. 34 is a perspective view of the mounting rail accessory of FIG. 32.

Rear sight accessory 200 is operably coupled to adapted semi-automatic handgun 80, and more specifically, to slide cover plate adapter 100, in a similar manner as previously described with respect to griping accessory 150. Generally, the rear sight accessory 200 is positioned such that the flange cavity 220 slides over the flange wall 130 and the bridge cavity 222 slides over the bridging member 120 as shown in FIGS. 27-30. When the flange wall 130 and bridging member 120 are fully seated within the accessory cavity 216, the front sight surface 208 is essentially flush against rear wall 72 of slide body 60 as seen in FIG. 31. By attaching the rear sight accessory 200 to the adapted semi-automatic handgun 80 and moving the rear sight 212 farther from the front sight 62, the sight radius is increased which can promote accuracy when aiming and firing adapted semi-automatic handgun 80.

A representative embodiment of a mounting rail accessory 300 design for use with slide cover plate adapter 100 is illustrated within FIGS. 32-36. Generally, mounting rail accessory 300 can comprise a rail body 302 having an exterior rear wall 304, an interior rear wall 305 and at least one rail surface 306 having an interior mounting wall 307. Rail surface 306 generally defines a series of rail members 308 spaced apart by grooves 310. Rail members 308 and grooves 310 can be configured and arranged to conform to conventional rail standards such as, for example, Picatinny and Weaver Rail mounting standards. An accessory cavity 312 can be defined on a bottom side 313 of the rail body 302 proximate the rear wall 304. Accessory cavity 312 is essentially identical to previously described adapter cavities 168, 216 and includes a flange cavity 314 and a bridge cavity 316. Rail body 302 can include an accessory aperture 318 extending between opposed sides of the rail body 302.

Figure 37:
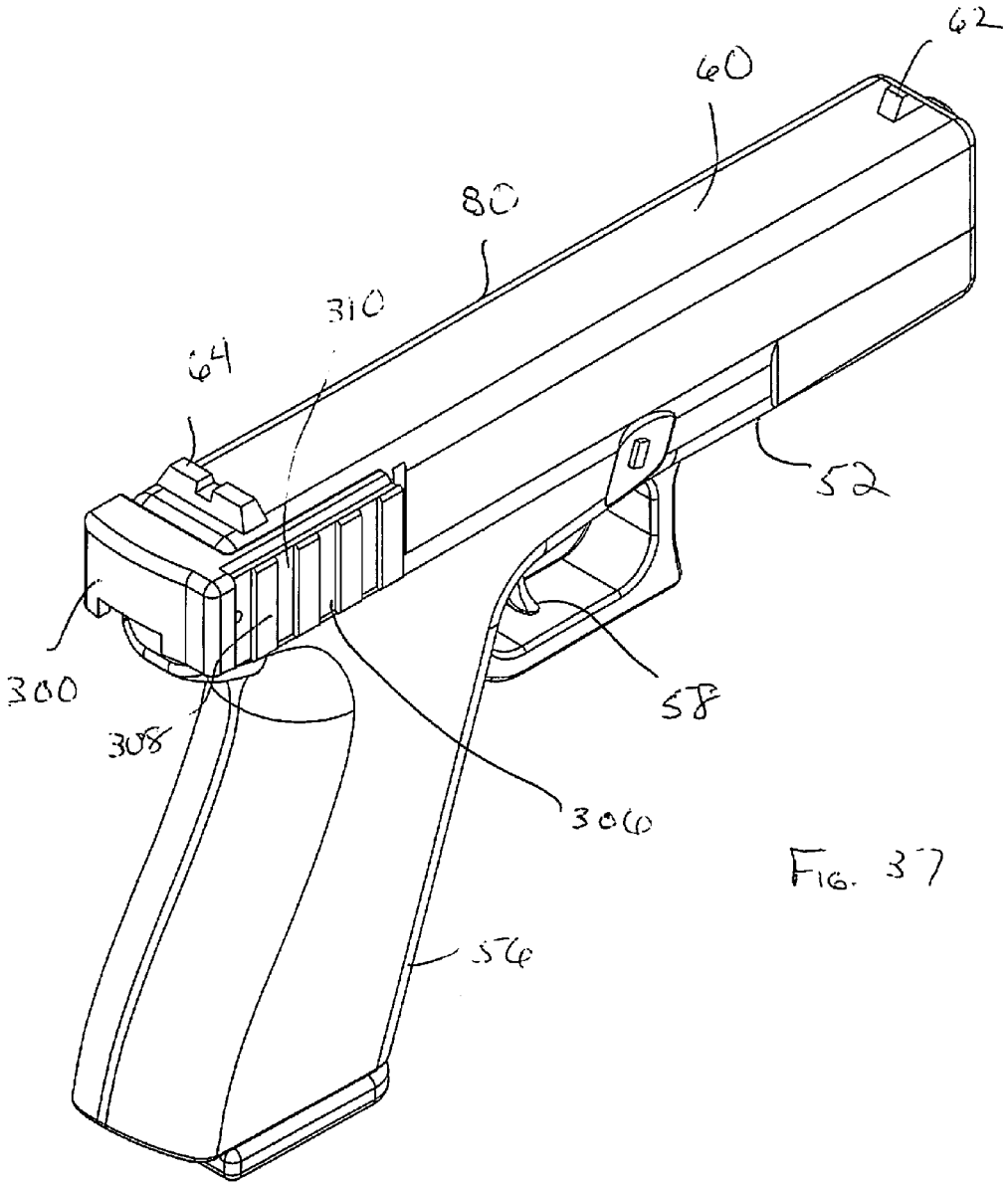
FIG. 37 is a perspective view of the adapted semi-automatic handgun of FIG. 10 including the mounting rail accessory of FIG. 32.
Figure 38:
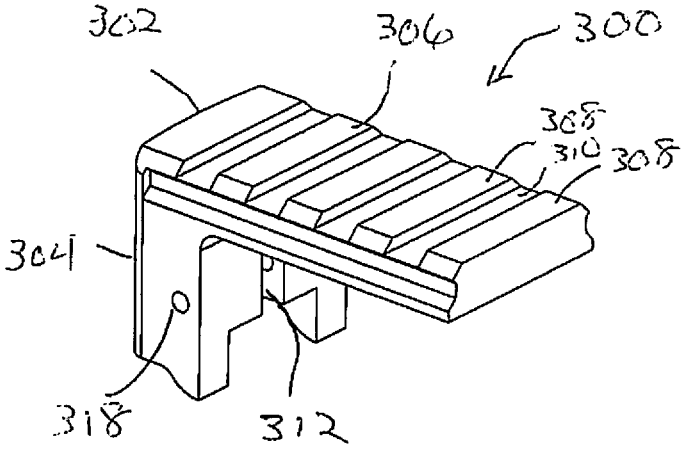
FIG. 38 is a perspective view of a mounting rail accessory according to an embodiment of the present invention.
Figure 39:
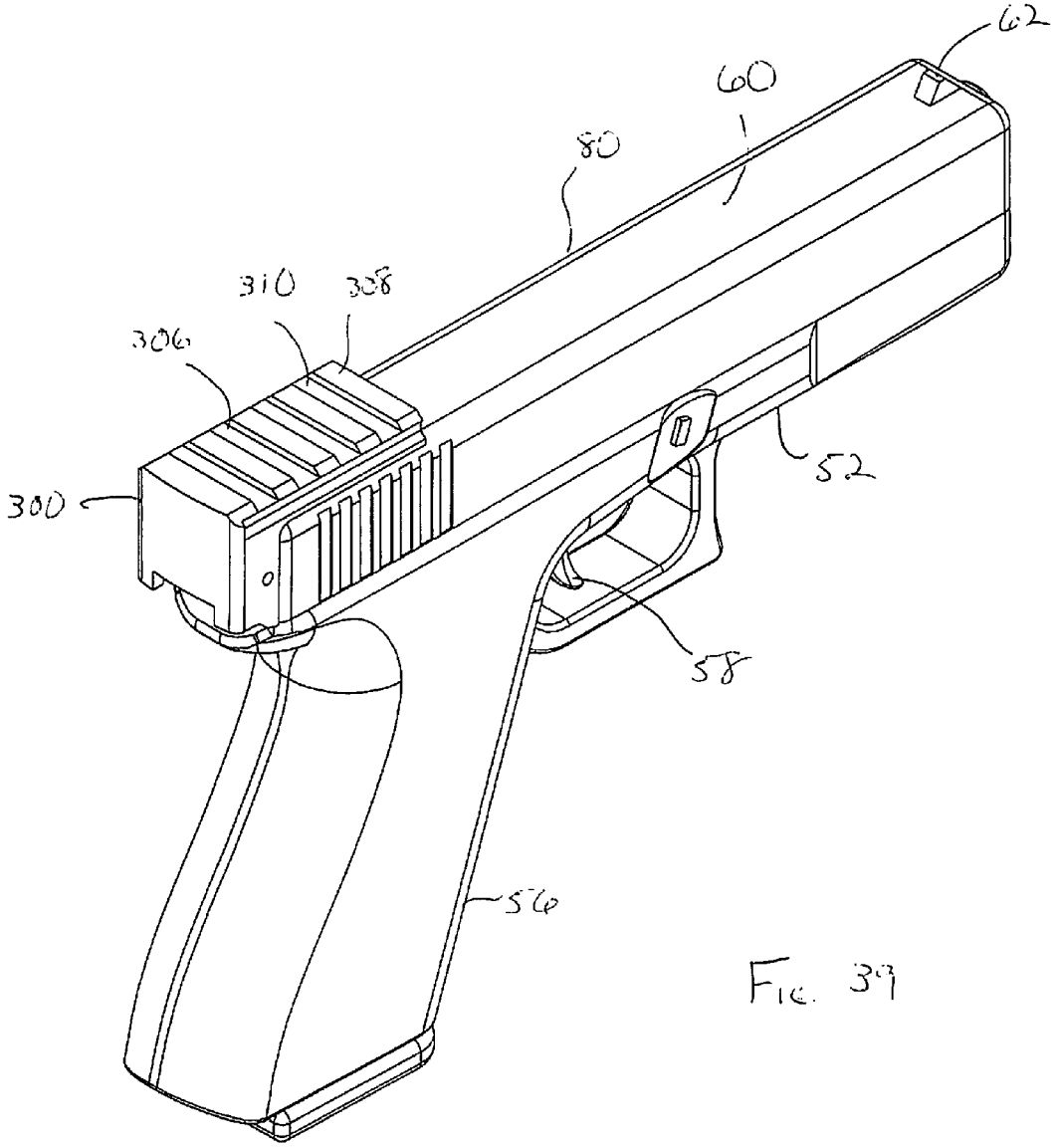
FIG. 39 is a perspective view of the adapted semi-automatic handgun of FIG. 10 including the mounting rail accessory of FIG. 38.

Mounting rail accessory 300 is operably coupled to adapted semi-automatic handgun 80, and more specifically, to slide cover plate adapter 100, in a similar manner as previously described with respect to griping accessory 150 and rear sight accessory 200. Generally, the mounting rail accessory 300 is positioned such that the flange cavity 314 slides over the flange wall 130 and the bridge cavity 316 slides over the bridging member 120. When the flange wall 130 and bridging member 120 are fully seated within the accessory cavity 312, the interior rear wall 305 is essentially flush against rear wall 72 of slide body 60 and the interior mounting wall 307 is flush against the slide body 60 as seen in FIG. 37. To further secure the mounting rail accessory 300, the user can insert pin 192 or threaded fastener 194 through the accessory aperture 318 and bridging aperture 124 as previously described with respect to gripping accessory 150 to lock the mounting rail accessory 300 to the slide cover plate adapter 100. By attaching the mounting rail accessory 300 to the adapted semi-automatic handgun 80, the at least one rail surface 306, and more specifically, the rail members 308 and grooves 310, configured in either a Picatinny or Weaver arrangement, provide a means for mounting any of a variety of conventional accessories including sights, scopes, lasers, guards, and any other suitable accessory that is configured for attachment to similar rails. In this way, additional functionality and customization is offered to a user of adapted semi-automatic handgun 80. As seen in FIGS. 38 and 39, mounting rail accessory 300 can be arranged to have a top mounted rail surface 306. Though not illustrated, it will be understood that mounting rail accessory 300 could have more than one rail surface 306 and in certain embodiments could have up to three rail surfaces including both sides and a top mounted rail surface. In addition, rail surface 306 could have a variety of lengths, and consequently, more or less rail members 308 and grooves 310.

As described throughout the previous specification, slide cover plate adapter 100 provides a convenient and secure mounting point for a wide variety for firearm accessories. It is to be understood that the design of the slide cover plate adapter 100 is amenable to various modifications and alternative forms so as to accommodate varying firearm manufacturers and models. The intention is not to limit the present invention to the particular embodiments described and illustrated but instead to cover all modifications, equivalents, and alternatives falling within the spirit and scope of the present disclosure.

The invention claimed is:

1. A handgun adapter system, comprising:

an adapter body having a channel engagement portion and an accessory engagement portion being separated by a bridging member to define a receiving area between the channel engagement portion and the accessory engagement portion, the channel engagement portion defining an engagement wall having an engagement profile, where said engagement profile is configured such that the engagement wall is adapted for slidable insertion within a cover channel of a slide body of a handgun with said receiving area being exposed rearward of the slide body; and an accessory having an accessory body, the accessory body defining an accessory cavity, wherein the accessory cavity receives the bridging member and the accessory engagement portion for coupling the accessory to the handgun.

2. The handgun adapter system of claim 1, wherein the accessory engagement portion includes a flange wall, and wherein the accessory cavity includes a flange cavity and a bridging cavity, said flange cavity receiving the flange wall and said bridging cavity receiving the bridging member.

3. The handgun adapter system of claim 1, wherein the bridging member includes a bridging aperture and the accessory body includes an accessory aperture, wherein coupling of the accessory to the striker-fired handgun aligns the bridging aperture with the accessory aperture to define a locking aperture, and wherein an insertion member is slidably inserted through the locking aperture to positively lock the accessory body to the undivided single piece adapter body.

4. The handgun adapter system of claim 1, wherein the accessory is selected from the group consisting of: a gripping accessory, a rear sight accessory and a mounting rail accessory.

5. A semi-automatic handgun comprising the handgun adapter system of claim 1.

6. A handgun adapter system, comprising:

an adapter body having a channel engagement portion, a bridging member and an accessory engagement portion, the channel engagement portion defining an engagement wall having an engagement profile, where said engagement profile is configured such that the engagement wall is adapted for slidable insertion within a cover channel of a slide body of a handgun, said bridging member including a bridging aperture; and an accessory having an accessory body, the accessory body defining an accessory cavity, wherein the accessory cavity receives the bridging member and the accessory engagement portion for coupling the accessory to the handgun, said accessory body further including an accessory aperture wherein coupling of the accessory to the handgun aligns the bridging aperture with the accessory aperture to define a locking aperture, and wherein an insertion member is slidably inserted through the locking aperture to positively lock the accessory body to the adapter body.

7. The handgun adapter system of claim 6, wherein the accessory engagement portion includes a flange wall, and wherein the accessory cavity includes a flange cavity and a bridging cavity, said flange cavity receiving the flange wall and said bridging cavity receiving the bridging member.

8. The handgun adapter system of claim 7, wherein the accessory is selected from the group consisting of: a gripping accessory, a rear sight accessory and a mounting rail accessory.

9. A semi-automatic handgun comprising the handgun adapter system of claim 8.

10. A semi-automatic handgun comprising the handgun adapter system of claim 6.

11. The semi-automatic handgun of claim 10, wherein the accessory engagement portion includes a flange wall, and wherein the accessory cavity includes a flange cavity and a bridging cavity, said flange cavity receiving the flange wall and said bridging cavity receiving the bridging member.

12. A handgun adapter system, comprising:

an adapter body having a channel engagement portion and an accessory engagement portion being separated by a bridging member to define a receiving area between the channel engagement portion and the accessory engagement portion, the channel engagement portion defining an engagement wall having an engagement profile, where said engagement profile is configured such that the engagement wall is adapted for slidable insertion within a cover channel of a slide body of a handgun with said receiving area being exposed rearward of the slide body, the accessory engagement portion including a flange wall, and an accessory having an accessory body, the accessory body defining an accessory cavity including a flange cavity and a bridging cavity, said flange cavity receiving the flange wall and said bridging cavity receiving the bridging member for coupling the accessory to the handgun.

13. The handgun adapter system of claim 12, wherein the bridging member includes a bridging aperture and the accessory body includes an accessory aperture, wherein coupling of the accessory to the handgun aligns the bridging aperture with the accessory aperture to define a locking aperture, and wherein an insertion member is slidably inserted through the locking aperture to positively lock the accessory body to the undivided single piece adapter body.

* * * * *